United States Patent [19]

Woods

[11] Patent Number: 4,569,281

[45] Date of Patent: Feb. 11, 1986

[54] APPARATUS FOR UNSCREWING JAR LIDS AND CRUSHING ALUMINUM CANS

[76] Inventor: David R. Woods, 4252 Northwest Rd., Bellingham, Wash. 98226

[21] Appl. No.: 688,234

[22] Filed: Jan. 2, 1985

[51] Int. Cl.[4] ..... B67B 7/36; B30B 9/32

[52] U.S. Cl. ..... 100/103; 81/3.33; 100/266; 100/293; 100/295; 100/902

[58] Field of Search ..... 81/3.09, 3.25, 3.31, 81/3.32, 3.33; 29/240; 100/902, 238, 266, 293, 295, 103

[56] References Cited

U.S. PATENT DOCUMENTS

| | | | |
|---|---|---|---|
| 1,856,827 | 5/1932 | Carruthers | 81/3.3 X |
| 2,897,699 | 8/1959 | Anderson | 81/3.3 X |
| 3,009,414 | 11/1961 | Griemert | 100/902 X |
| 3,812,742 | 5/1974 | Polasek | 81/3.3 X |
| 3,934,498 | 1/1976 | Hochanadel | 100/902 X |
| 3,950,801 | 4/1976 | Morrison | 81/3.3 X |
| 4,102,226 | 7/1978 | McGuire | 81/3.3 X |
| 4,143,595 | 3/1979 | Carlson | 100/902 X |
| 4,197,796 | 4/1980 | Salatka | 100/902 X |
| 4,290,354 | 9/1981 | Stevens | 100/902 X |
| 4,334,469 | 6/1982 | Tanner | 100/902 X |

*Primary Examiner*—Billy J. Wilhite
*Attorney, Agent, or Firm*—Norman B. Rainer

[57] ABSTRACT

A manually operable apparatus is provided for crushing metal cans and unscrewing lids of jars. The apparatus is comprised of a base, a guide rising upwardly from the base, an overhead assembly which slidably engages the guide, and a handle adapted to cause vertical movement of the overhead assembly. A can or jar to be acted upon is positioned upright upon the base. Forceful downward movement of the overhead assembly accomplishes the desired effect.

7 Claims, 3 Drawing Figures

APPARATUS FOR UNSCREWING JAR LIDS AND CRUSHING ALUMINUM CANS

BACKGROUND OF THE INVENTION

This invention relates to apparatus having the dual capability of unscrewing closure lids from containers such as jars, and causing endwise compactive crushing of thin-walled aluminum beverage cans.

In kitchens dealing with food preparation and serving, whether commercial operations such as restaurants and institutional facilities, or private home facilities, there is frequent need to open containers sealed by screw-type closure lids. There is also a general need to compact empty aluminum cans so that the compacted cans will occupy less space during their accumulation prior to transport to a metal recycling operation.

Although both operations can be done manually, there is considerable convenience in utilizing mechanical devices for these tasks. Suitable devices have been available for the performance of each function. However, in view of the limited space availability in most kitchens, the presence of one device of small size would be considered preferable to the presence of two separate space-occupying devices. Furthermore, from a cost standpoint, a single device might be less expensive than two separate devices, especially where certain features of each device are duplicated.

It is accordingly an object of the present invention to provide an apparatus having the dual capability of unscrewing closure lids and crushing thin-walled metal cans.

It is a further object of this invention to provide an apparatus of the aforesaid nature which occupies less space than would two devices for separately providing the same dual capability.

It is a still further object of the invention to provide a dual function apparatus of the aforesaid nature of simple and rugged construction which may be economically manufactured.

These objects and other objects and advantages of the invention will be apparent from the following description.

SUMMARY OF THE INVENTION

The above and other beneficial objects and advantages are accomplished in accordance with the present invention by a lever-operated apparatus which comprises:

(a) a base member having a horizontally disposed upper surface, forward, rearward and side extremities, and a center plane of symmetry, (b) stationary lower resilient gripping means positioned upon the upper surface of said base member, (c) straight guide means rising perpendicularly from said base member adjacent the rearward extremity thereof and centered about said plane of symmetry, (d) a generally U-shaped handle having two opposed arms provided with upwardly angled lever portions terminating in a bifurcated extremity which pivotably engages said guide means in a manner permitting swinging movement of said handle above said base member in a vertical path between an upper and lower position, (e) an overhead assembly positioned above said base member and comprising: (1) a cap member having a substantially flat horizontally disposed top panel provided with a center aperture and several arcuate apertures disposed in a circular locus about said center aperture, and support means which slideably engage said guide means, and (2) a cylindrical drum comprising: (a) a sidewall of circular cross section disposed about a vertically oriented axis within said plane of symmetry, (b) an open upper extremity, (c) a bottom panel, (d) a series of segments in said sidewall defined by parallel helical slots communicating with said open upper extremity, said segments adapted to slidably penetrate said arcuate apertures, (e) selection means to optionally prevent penetration of said apertures by said segments, (f) a control post centered upon the bottom panel of said drum and extending along said vertical axis into penetrative sliding engagement with the center aperture of said top panel, (f) a coil spring positioned about said control post, extending in abutment between the top panel of said cap member and the bottom panel of said drum, and adapted to restore a desired distance of separation between said cap member and bottom panel following their compressive interaction, said desired distance being controlled by said control post, (g) a pair of connecting struts, each extending in pivoted engagement between said cap member and a site on said handle where the lever portions angle with respect to the arms, (h) moving upper resilient gripping means associated with the bottom panel of said drum and disposed above said lower gripping means in facing juxtaposition therewith, whereby (i) downward movement of the handle pulls the cap member closer to the base member, whereby (j) when the segments are permitted to penetrate the arcuate apertures, and a screw cap jar is interposed between upper and lower gripping means, downward force of said upper gripping means upon said screw cap drives said segments through said cap member against the urging of said coil spring, producing a counter clockwise rotative force which unscrews said screw cap, and release of said downward force enables said spring to restore the spacing between the cap and upper gripping means, and (k) when the segments are prevented from penetrating said arcuate apertures, and a metal can is interposed between upper and lower gripping means, downward force of said upper gripping means upon said can produces sufficient compressive force to crush the can.

In a preferred embodiment, the straight guide means is a track-like structure interactive with the support means of the cap member. The lower gripping means is preferably concavely shaped in an upward direction, and the upper gripping means is concavely shaped in a downward direction. The underside of the base member is preferably provided with suction cups to permit secure emplacement of the device upon a flat work surface.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

Figure 1:
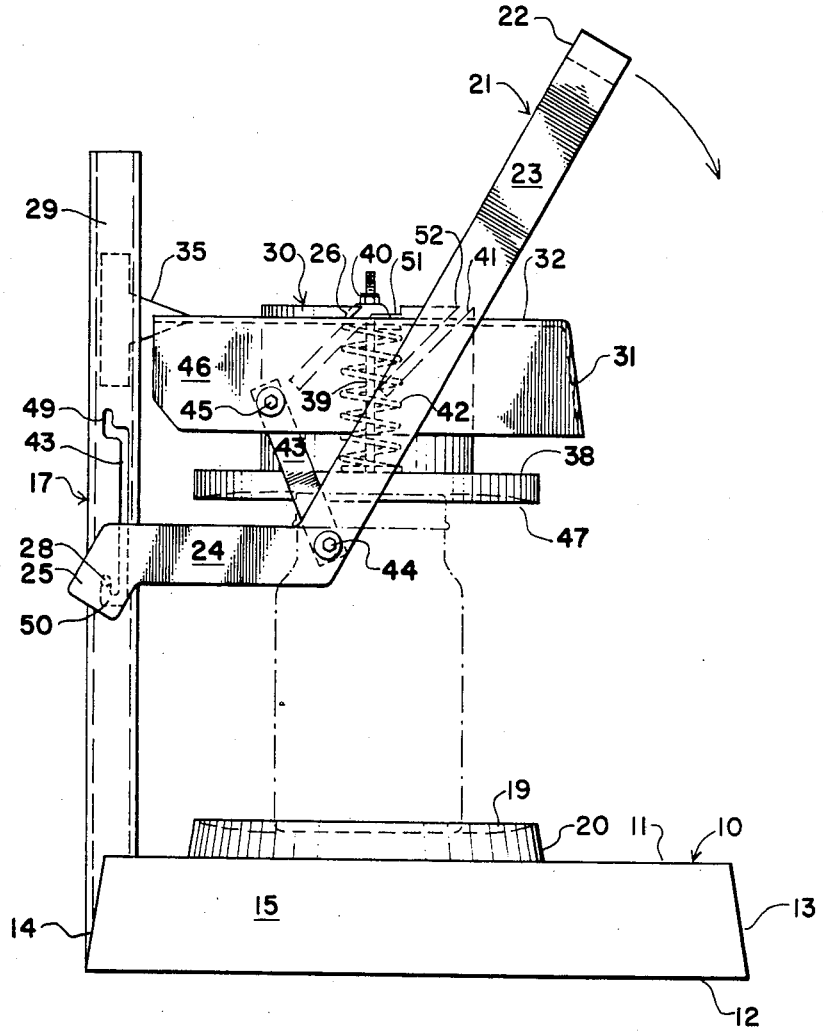
FIG. 1 is a side view of an embodiment of the apparatus of the present invention with portions broken away to reveal interior details, and showing a jar operatively positioned within the apparatus and the handle in its upper position.

For convenience in description, the terms "front" or "forward" and "rear", or words of similar import, will have reference to the right and left ends, respectively, of the apparatus appearing in FIG. 1. The terms "upper" and "lower" and equivalents thereof will have reference to the upper and lower portions, respectively, of the apparatus of FIG. 1.

DESCRIPTION OF THE PREFERRED EMBODIMENT

Figure 2:
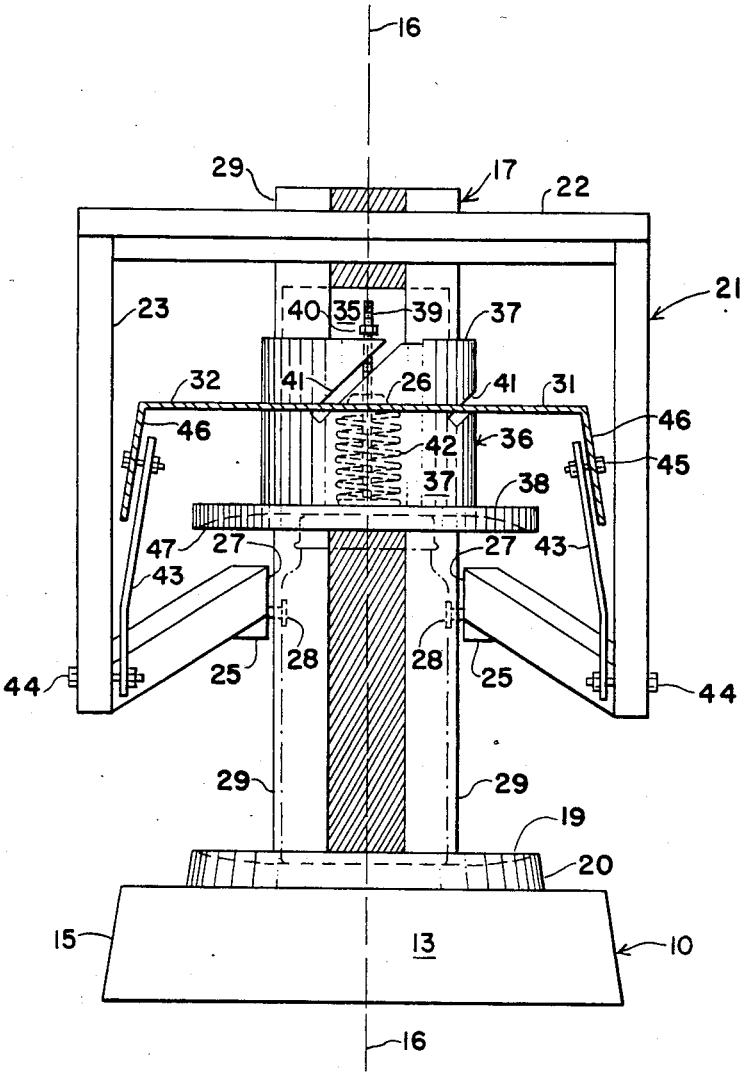
FIG. 2 is a front view of the apparatus of FIG. 1, with the handle in its lower position.
Figure 3:
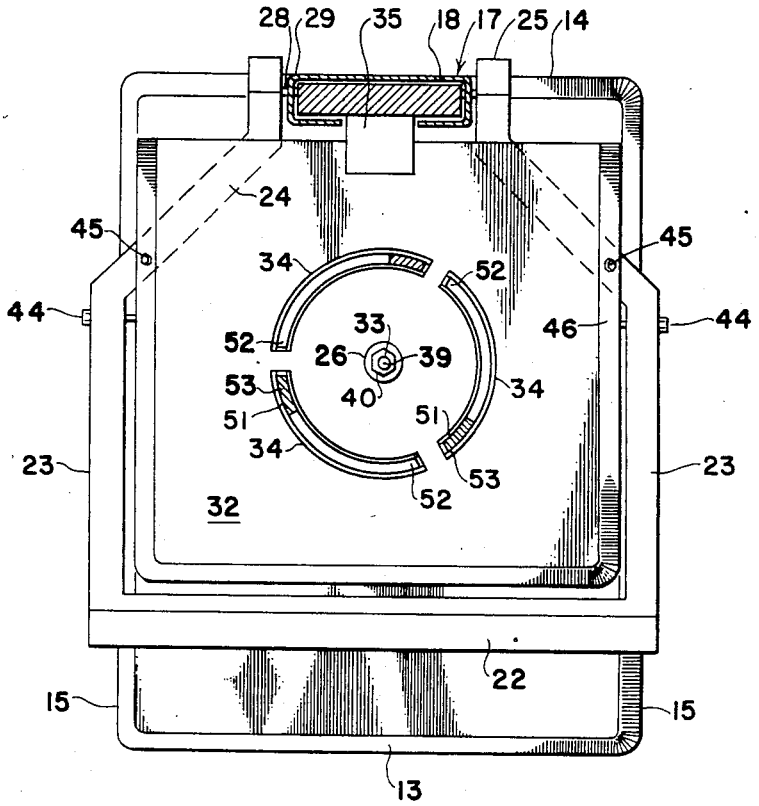
FIG. 3 is a top view of the apparatus of FIG. 1 with portions broken away to reveal interior detail.

Referring to FIGS. 1–3, an apparatus of this invention intended to be operatively positioned upon a horizontally disposed flat work surface is shown having base member 10 of generally rectangular contour comprising upper surface 11, lower surface 12, forward edge 13, rearward edge 14, side extremities 15, and a centered vertical plane of symmetry referred to generally by reference numeral 16. Guide means in the form of track 17 of C-shaped cross section is affixed to said base member adjacent rearward edge 14, and rises vertically therefrom in centered disposition about said plane of symmetry. The guide track has a substantially hollow interior 18 of uniform cross sectional configuration, as best shown in FIG. 3, thereby facilitating sliding retention of an internal meaber, as will hereinafter be shown.

Stationary lower gripping means 19 are positioned within circular holder ring 20 atop upper surface 11 of said base member, said gripping means being comprised of a resilient material such as rubber having an upwardly directed concave configuration.

Handle 21, of generally U-shaped, integral construction is provided having horizontally disposed manipulating bar 22, opposed straight arms 23 joined to bar 22 in parallel relationship in spaced apart vertical planes, and lever portions 24 which emerge from the lower extremities of said straight arms as continuous extensions thereof and directed inwardly toward each other in angled relationship to arms 23. The terminal extremities of lever portions 24 are each provided with tab 25 having a vertically disposed flat abutment surface 27. Said handle is pivotably attached to track 17 by means of retaining posts 28 held by tabs 25 and adjustably engaged by vertically disposed slots 43 in the side extremities 29 of said track. As best shown in FIG. 1, upper and lower upwardly directed holding channels 49 and 50, respectively, communicate with slots 43. In said FIG. 1, retaining posts 28 are shown in engagement with lower holding channels 50. In other embodiments, additional holding channels may be associated with slots 43. By virtue of its manner of attachment to track 17, the handle can undergo swinging movement in a vertical path between upper and lower positions.

Overhead assembly 30, comprised of cap member 31 and drum assembly 36, is positioned above base member 10. Cap member 31 is comprised of flat horizontally disposed top panel 32 provided with center aperture 33 and three arcuate apertures 34 disposed in a circular path about aperture 33. Support bracket 35 extends rearwardly from top panel 32 and slideably engages the hollow interior of track 17.

Drum assembly 36, having sidewall 37 of circular cylindrical configuration, and horizontal bottom panel 38, is attached to top panel 32 by threaded post 39 which extends from panel 38 along the center axis of sidewall 37 within plane of symmetry 16 and through center aperture 33 into engagement with nut 40. An upwardly convex spring steel washer 26 is positioned between nut 40 and top panel 32. Two or more parallel helical slots 41 within sidewall 37 communicate with the open upper extremity of drum assembly 36, thereby creating segments having advance edge 52 and trailing edge 53 which slidably penetrate the arcuate apertures in top panel 32. A rectangular portion is removed from the top of each segment adjacent its trailing edge to constitute a notch 51 for controlling the mode of operation of the overhead assembly.

Coil spring 42 is disposed about post 39, and extends in abutment between bottom panel 38 of drum assembly 36 and the underside of top panel 32. Such mode of disposition of the coil spring serves to force apart drum 36 and cap member 31. The maximum extent of separation of said components is controlled by the position of nut 40 upon post 39.

A pair of straight rigid connecting struts 43 are provided having upper and lower extremities. The lower extremity of each strut 43 is connected by lower pivot bolt 44 to the lower extremity of straight arm 23 adjacent the site of emergence of lever portion 24. The upper extremity of each strut is connected by upper pivot bolt 45 to sidewall 46 of cap member 31. In the various positions of the handle, the lower extremity of each strut 43 will generally be forward of its upper extremity. However, at the maximum upper and lower positions of the handle, the struts will be in substantially vertical disposition. The function of the struts is to cause the pivoting motion of the handle to be translated into a vertically directed force for raising or lowering overhead assembly 30 in sliding engagement with track 17.

Upper, or moving, gripping means 47 is a rubber disc having a downwardly opening concave face, and is housed beneath bottom panel 38 of the drum assembly in axially aligned disposition above said lower gripping means.

When used for unscrewing lids from jars, the starting position of drum assembly 36 is as shown in FIG. 1 with the handle in its upper position. As the handle is depressed, the segments of the drum penetrate the arcuate apertures 34, as shown in FIG. 2, while advance edges 52 of the segments bear against one extremity of each arcuate aperture to cause the drum to rotate in a counterclockwise direction, as viewed from above. The rotation causes the lid of the jar to become unscrewed. It is to be noted that downward motion of the drum ceases when its rotational motion begins.

When used for crushing cans, the drum assembly is manually pulled down and rotated in a clockwise direction as viewed from above, thereby causing notch 51 to lie beneath top panel 32. When the handle is then depressed, the drum assembly will be drawn vertically downwardly without any rotative motion, providing sufficient compressive force to crush thin-walled beverage cans of currently popular design.

In either mode of use, upon removal of the downward force from the handle, the coil spring returns the handle to its upward position, and restores the separation between the cap member and upper gripping means. In either mode of operation, the jar or can is placed in upright position upon the lower gripping means.

While particular examples of the present invention have been shown and described, it is apparent that changes and modifications may be made therin without departing from the invention in its broadest aspects. The aim of the appended claims, therefore, is to cover all such changes and modifications as fall within the true spirit and scope of the invention.

Having thus described my invention, what is claimed is:

1. An apparatus for unscrewing the caps of jars, and crushing cans comprising:

(a) a base member having a horizontally disposed upper surface, and forward, rearward and side extremities, (b) stationary lower resilient gripping means positioned upon the upper surface of said base member, (c) straight guide means rising perpendicularly from said base member adjacent the rearward extremitv thereof, (d) a generally U-shaped handle having two opposed arms provided with angled lever portions terminating in a bifurcated extremity which pivotably engages said guide means in a manner permitting swinging movement of said handle above said base member in a vertical path between an upper and lower position, (e) an overhead assembly positioned above said base member and comprising: (1) a cap member having a substantially flat horizontally disposed top panel provided with a center aperture and several arcuate apertures disposed in a circular locus about said center aperture, and support means which slideably engage said guide means, and (2) a cylindrical drum comprising: (a) a sidewall of circular cross section disposed about a vertically oriented axis, (b) an open upper extremity, (c) a bottom panel, (d) several segments in said sidewall defined by parallel helical slots communicating with said open upper extremity, said segments adapted to slidably penetrate said arcuate apertures, (e) selection means to optionally prevent penetration of said apertures by said segments, (f) a control post centered upon the bottom panel of said drum and extending along said vertical axis into penetrative sliding engagement with the center aperture of said top panel, and (g) stop means in threaded engagement with said control post above said top panel, (f) a coil spring positioned about said control post, extending in abutment between the top panel of said cap member and the bottom panel of said drum, and adapted to urge said cap member to a desired distance from said bottom panel, said desired distance being controlled by the position of said stop means, (g) a pair of connecting struts, each extending in pivoted engagement between said cap member and a site on said handle where the lever portions angle with respect to the arms, (h) moving upper resilient gripping means associated with the bottom panel of said drum and disposed above said lower gripping means in facing juxtaposition therewith, whereby (i) downward movement of the handle pulls the cap member closer to the base member, whereby (j) when the segments are permitted to penetrate the arcuate apertures, and a screw cap jar is interposed between upper and lower gripping means, downward force of said upper gripping means upon said screw cap drives said segments through said cap member against the urging of said coil spring, producing a rotative force which unscrews said screw cap, and release of said downward force enables said spring to restore the spacing between the cap member and upper gripping means, and (k) when the segments are prevented from penetrating said arcuate apertures, and a metal can is interposed between upper and lower gripping means, downward force of said upper gripping means upon said can produces sufficient compressive force to crush the can.

2. The apparatus of claim 1 wherein the arcuate apertures and segments of the drum are equal in number, said number being between two and five.

3. The apparatus of claim 2 further characterized in having a plane of symmetry which vertically bisects said base member between its side extremities.

4. The apparatus of claim 2 wherein the straight guide means is a tracklike structure interactive with the support means of the cap member.

5. The apparatus of claim 2 wherein the lower gripping means is concavely shaped in an upward direction, and the upper gripping means is concavely shaped in a downward direction.

6. The apparatus of claim 2 wherein each segment of said drum is further characterized in having an advance edge adapted to bear against the upper panel of the cap member, and a trailing edge parallel to said advance edge.

7. The apparatus of claim 6 wherein said selection means comprises a notch associated with uppermost extremity of each segment adjacent the trailing edge thereof.

* * * * *